US006442474B1

(12) United States Patent
Trajkovic et al.

(10) Patent No.: US 6,442,474 B1
(45) Date of Patent: Aug. 27, 2002

(54) VISION-BASED METHOD AND APPARATUS FOR MONITORING VEHICULAR TRAFFIC EVENTS

(75) Inventors: Miroslav Trajkovic, Ossining; Srinivas Gutta, Buchanan, both of NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/731,539

(22) Filed: Dec. 7, 2000

(51) Int. Cl.[7] ..... G06G 7/76
(52) U.S. Cl. ..... 701/117; 348/149
(58) Field of Search ..... 701/117, 119; 348/148, 149; 340/936, 937; 382/104

(56) References Cited

U.S. PATENT DOCUMENTS

| | | | | |
|---|---|---|---|---|
| 4,970,653 A | | 11/1990 | Kenue | 364/461 |
| 5,677,979 A | | 10/1997 | Squicciarini et al. | 386/46 |
| 5,757,287 A | * | 5/1998 | Kitamura et al. | 340/934 |
| 5,969,755 A | * | 10/1999 | Courtney | 348/135 |
| 6,081,206 A | * | 6/2000 | Kielland | 194/902 |
| 6,121,898 A | * | 9/2000 | Moetteli | 340/905 |
| 6,188,329 B1 | * | 2/2001 | Glier et al. | 340/933 |

FOREIGN PATENT DOCUMENTS

EP 0567059 B1 12/1998

OTHER PUBLICATIONS

Sal D'Agostino, "Commercial Machine Vision System for Traffic Monitoring and Control," SPIE, vol. 1615 Machine Vision Architectures, Integration and Applications 180–86 (1991).

Nathanael Rota and Monique Thonnat, "Video Sequence Interpretation for Visual Surveillance," in Proc. of the 3d IEEE Int'l Workshop on Visual Surveillance, 59–67, Dublin, Ireland (Jul. 1, 2000).

Jonathan Owens and Andrew Hunter, Application of the Self–Organizing Map to Trajectory Classification, in Proc. of the 3d IEEE Int'l Workshop on Visual Surveillance, 77–83, Dublin, Ireland (Jul. 1, 2000).

* cited by examiner

*Primary Examiner*—Michael J. Zanelli

(57) ABSTRACT

A method and apparatus are disclosed for monitoring traffic using vision-based technologies to recognize events and violations. The disclosed traffic monitoring system includes one or more image capture devices focused on a roadway where vehicles travel. The captured images are processed by the traffic monitoring system to identify one or more pre-defined events or traffic violations. A number of rules can be utilized to define various traffic-related events, including traffic violations. Each rule contains one or more conditions, and, optionally, a corresponding action-item that should be performed when the rule is satisfied. Upon detection of a predefined traffic event, the corresponding action, if any, is performed by the traffic monitoring system.

13 Claims, 5 Drawing Sheets

TRAFFIC EVENT DATABASE -- 300

| | RULE CRITERIA 350 | ACTION 360 |
|---|---|---|
| 305 | VEHICLE RATE EXCEEDS LOW THRESHOLD THROUGH STOP SIGN AREA | ISSUE TICKET FOR FAILING TO STOP |
| 306 | TRAJECTORY IS WITHIN PREDEFINED THRESHOLD OF PREDEFINED ILLEGAL TURN TRAJECTORY | ISSUE TICKET FOR ILLEGAL TURN |
| 307 | LARGE TRUCKS AT OFF-HOURS | INCREMENT COUNTER |
| 308 | VEHICLE RATE EXCEEDS THRESHOLD | ISSUE TICKET FOR SPEEDING |
| 309 | ••• | |
| 310 | TRUCK ON PARKWAY | NOTIFY POLICE AND ISSUE TICKET FOR ILLEGAL ENTRY |

FIG. 3

VISION-BASED METHOD AND APPARATUS FOR MONITORING VEHICULAR TRAFFIC EVENTS

FIELD OF THE INVENTION

The present invention relates to methods and apparatus for monitoring traffic to detect events or violations, such as speeding, and more particularly, to a method and apparatus for monitoring traffic events using vision-based recognition techniques.

BACKGROUND OF THE INVENTION

Many law enforcement agencies must operate with insufficient financial resources or manpower (or both). Thus, such law enforcement agencies often have insufficient resources to effectively perform more routine tasks, such as enforcement of traffic violations. The irony, of course, is that increased enforcement of such traffic violations could lead to increased revenue for the law enforcement agencies or municipalities. In addition, studies suggest that the public perception of a reduced level of enforcement of traffic violations has led to an increase in the percentage of vehicles that routinely violate the traffic laws. For example, the percentage of all highway vehicles traveling at a speed above the posted limit is increasing at alarming rates.

A number of automated techniques have been proposed or suggested for monitoring vehicular traffic and detecting traffic violations. If successful, such automated techniques could (i) free up law enforcement personnel for more important tasks, such as investigation and prevention of crimes; (ii) generate increased revenue for the law enforcement agencies or municipalities; and (iii) increase the public perception that traffic laws will be diligently enforced, thereby reducing the percentage of vehicles violating the traffic laws and increasing public safety.

Most currently available traffic monitoring systems use sensors or other devices to detect traffic violations. For example, road-sensors embedded in the pavement or motion sensors can detect a vehicle traveling through an intersection after the traffic control signal has turned red. Likewise, a radar system can detect a vehicle traveling at a speed above the posted limit. Currently available traffic monitoring systems are often supplemented with one or more cameras to obtain images as evidentiary proof of the traffic violation. For example, a number of municipalities employ traffic monitoring systems that detect traffic violations and obtain an image of the vehicle, typically including the license plate number and, optionally, an image of the driver. An image is utilized purely to establish that the vehicle or driver was associated with the traffic violation.

While such traffic monitoring systems do (i) free up law enforcement personnel for more important tasks; (ii) generate increased revenue for the law enforcement agencies or municipalities; and (iii) increase the public perception that traffic laws will be diligently enforced, they suffer from a number of limitations, which if overcome, could greatly expand the utility and effectiveness of such traffic monitoring systems. Specifically, currently available traffic monitoring systems require the coordination of two distinct units, namely, the external sensor (or radar) and the image capture device. The installation of sensors in existing pavement or other locations, however, is often expensive or impractical. Furthermore, while the monitoring systems incorporate camera technologies, they fail to exploit additional information that can be obtained from the images.

A need therefore exists for a traffic monitoring system that uses vision-based technologies to recognize events and violations, such as speeding, directly from images of vehicular traffic. A further need exists for a traffic monitoring system that employs a rule-base to define each violation or event.

SUMMARY OF THE INVENTION

Generally, a method and apparatus are disclosed for monitoring traffic using vision-based technologies to recognize events and violations. The disclosed traffic monitoring system includes one or more image capture devices that are focused on a roadway where vehicles travel. The captured images are processed by the traffic monitoring system to identify one or more predefined events or traffic violations.

According to one aspect of the invention, a number of rules are utilized to define various traffic-related events, including traffic violations. Each rule contains one or more conditions that must be satisfied in order for the rule to be triggered, and, optionally, a corresponding action-item that should be performed when the rule is satisfied. At least one condition for each rule identifies a feature that must be detected in an image using vision-based techniques. Upon detection of a predefined traffic event, the corresponding action, if any, is performed by the traffic monitoring system. When the identified event is a traffic violation, for example, the corresponding action item may be the automatic issuance of a summons.

An illustrative traffic violation detection process is disclosed that processes the images obtained by the image capture devices to detect a number of specific, yet exemplary, traffic violations. In addition, a traffic event monitoring process is disclosed to illustrate the general concepts of the present invention. The disclosed traffic event monitoring process processes the captured images and detects one or more events defined by the traffic event rules.

A more complete understanding of the present invention, as well as further features and advantages of the present invention, will be obtained by reference to the following detailed description and drawings.

BRIEF DESCRIPTION OF THE DRAWINGS

FIG. 3 illustrates a sample table from the traffic event database of FIG. 1;

DETAILED DESCRIPTION

Figure 1:
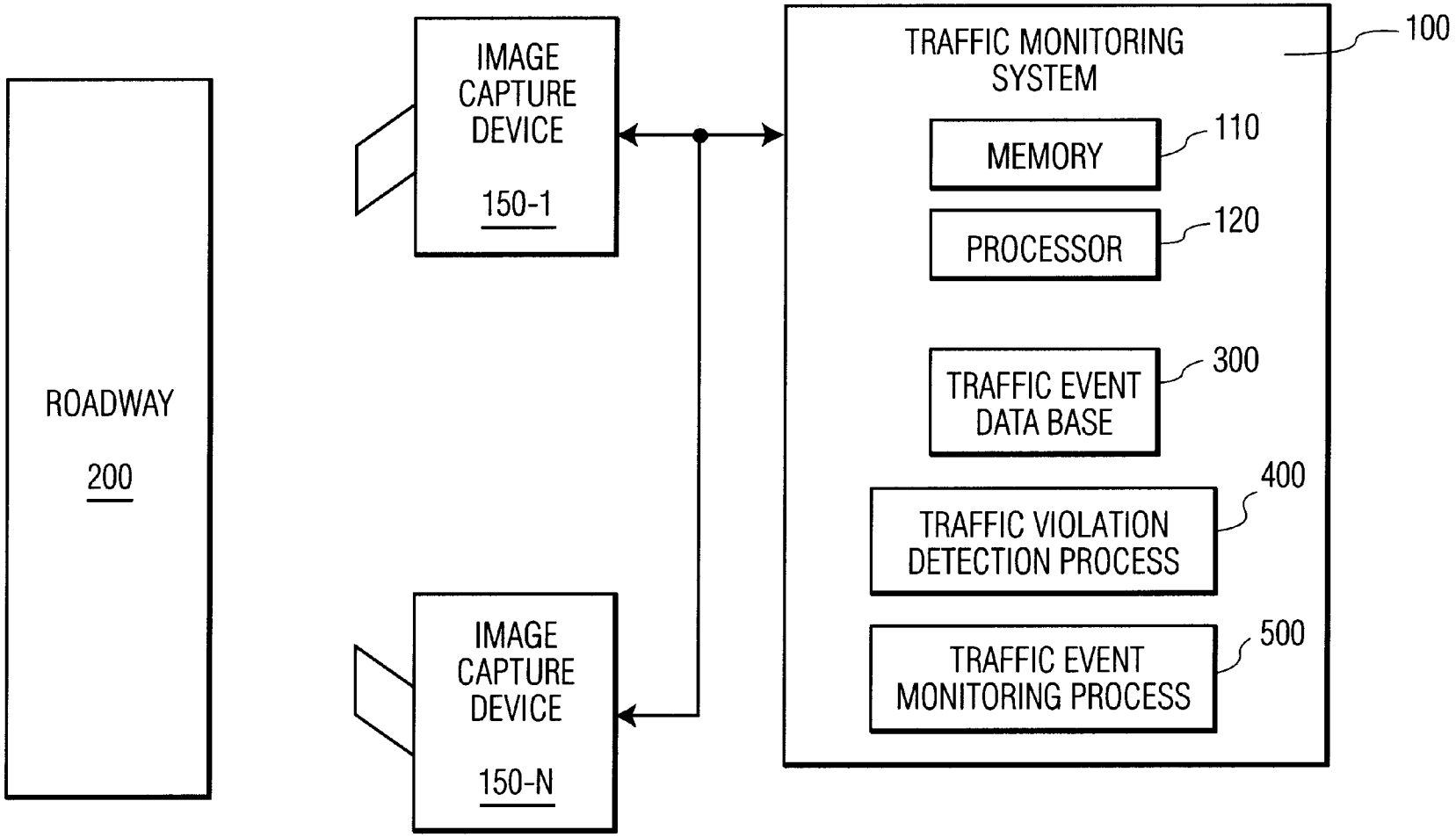
FIG. 1 illustrates a traffic monitoring system in accordance with the present invention.

FIG. 1 illustrates a traffic monitoring system 100 in accordance with the present invention. As shown in FIG. 1, the traffic monitoring system 100 includes one or more image capture devices 150-1 through 150-N (hereinafter, collectively referred to as image capture devices 150) that are focused on a roadway 200, discussed further below in conjunction with FIG. 2, where vehicles travel.

Each image capture device 150 may be embodied, for example, as a fixed or pan-tilt-zoom (PTZ) camera for capturing image or video information. The images generated by the image capture devices 150 are processed by the traffic monitoring system 100, in a manner discussed below in conjunction with FIGS. 4 and 5, to identify one or more predefined events or traffic violations. In one implementation, the present invention employs a traffic event database 300, discussed further below in conjunction with FIG. 3, that records a number of rules defining various traffic-related events, including traffic violations.

The traffic-related events defined by each rule may be detected by the traffic monitoring system 100 in accordance with the present invention. As discussed further below, each rule contains one or more criteria that must be satisfied in order for the rule to be triggered, and, optionally, a corresponding action-item that should be performed when the predefined criteria for initiating the rule is satisfied. At least one of the criteria for each rule is a condition detected in an image using vision-based techniques, in accordance with the present invention. Upon detection of such a predefined traffic event, the corresponding action, if any, is performed by the traffic monitoring system 100.

As shown in FIG. 1, and discussed further below in conjunction with FIGS. 3 through 5, respectively, the traffic monitoring system 100 also contains a traffic violation detection process 400 and a traffic event monitoring process 500. Generally, the traffic violation detection process 400 processes the images obtained by the image capture devices 150 and detects a number of specific, yet exemplary, traffic violations. The traffic event monitoring process 500 is a more general process illustrating the concept of the present invention. The traffic event monitoring process 500 processes images obtained by the image capture devices 150 and detects one or more events defined in the traffic event database 300.

The traffic monitoring system 100 may be embodied as any computing device, such as a personal computer or workstation, that contains a processor 120, such as a central processing unit (CPU), and memory 110, such as RAM and/or ROM.

Figure 2:
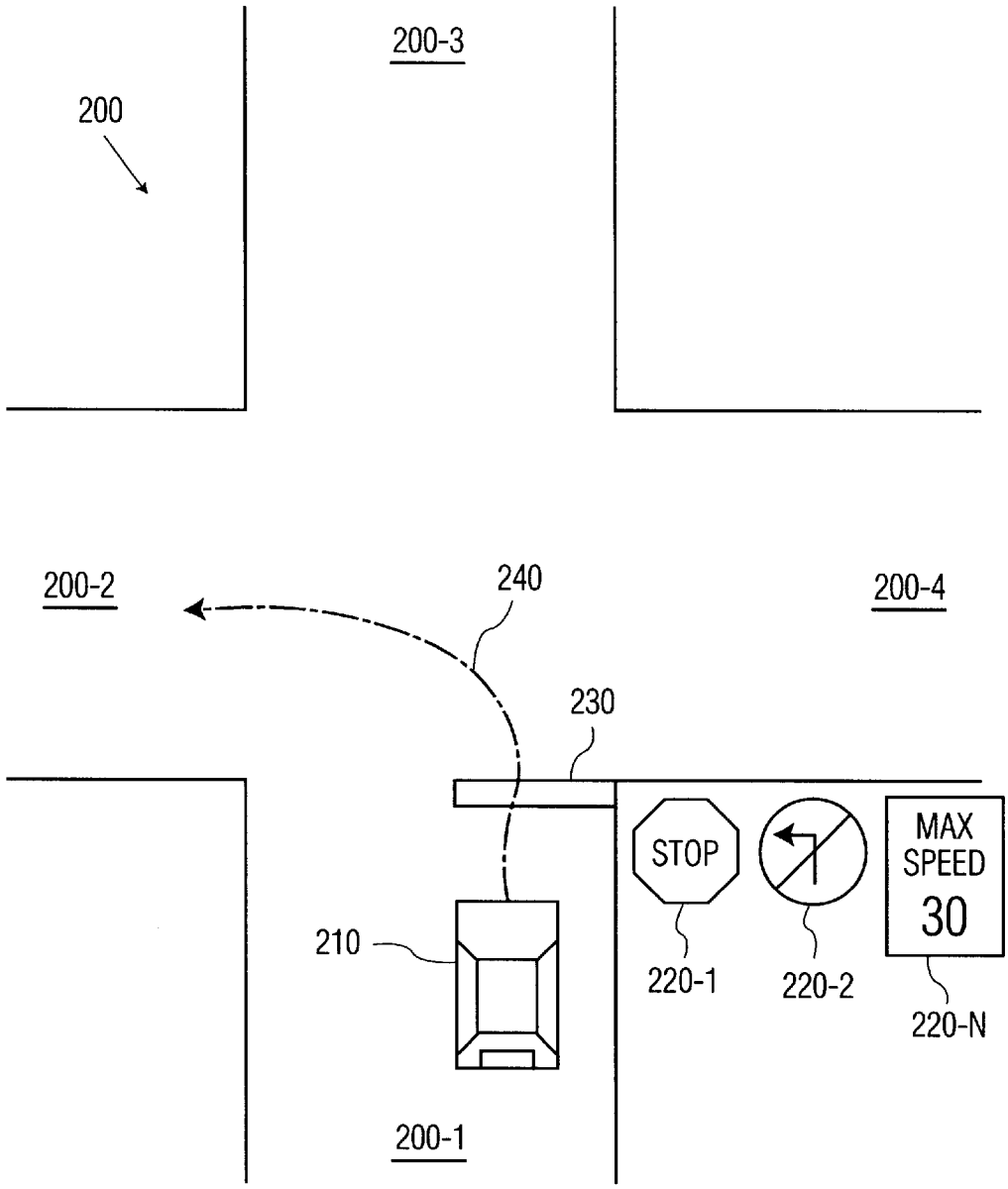
FIG. 2 illustrates an exemplary traffic intersection that may be monitored in accordance with the present invention.

FIG. 2 illustrates an exemplary traffic intersection 200 that may be monitored in accordance with the present invention. As shown in FIG. 2, a vehicle 210 is traveling along a first portion 200-1 of a roadway and approaching an intersection defined by a stop line 230. The exemplary intersection is marked by a number of traffic control signs 220, including a stop sign 220-1, a no-left turn sign 220-2 and a speed limit sign 220-N. The illustrative vehicle 210 travels along the first 200-1 of a roadway, approaches the stop line 230 and proceeds to make a left turn defined by a trajectory 240 and proceeds along a second portion 200-2 of the roadway.

According to one feature of the present invention, the traffic monitoring system 100 processes images of the intersection 200 to detect violations of one or more of the traffic control signs 220. Thus, the traffic monitoring system 100 can detect if the vehicle 210 travels along the roadway at an excessive speed, in violation of the speed limit posted on sign 220-N. In addition, the traffic monitoring system 100 can detect if the vehicle 210 fails to come to a complete stop at the stop sign 220-1. Finally, the exemplary traffic monitoring system 100 can detect if the vehicle 210 makes an illegal left turn, in violation of the posted no-left turn sign 220-2.

FIG. 3 illustrates an exemplary table of the traffic event database 300 that records each of the rules that define various traffic-related events. Each rule in the traffic event database 300 includes predefined criteria specifying the conditions under which the rule should be initiated, and, optionally, a corresponding action item that should be triggered when the criteria associated with the rule is satisfied. Typically, the action item defines one or more appropriate step(s) that should be performed when the rule is triggered.

As shown in FIG. 3, the exemplary traffic event database 300 maintains a plurality of records, such as records 305–310, each associated with a different rule. For each rule, the traffic event database 300 identifies the rule criteria in field 350 and the corresponding action item, if any, in field 360. For example, the rule recorded in record 306 is an event corresponding to an illegal left turn. As indicated in field 350, the rule in record 306 is triggered when the vehicle trajectory is within a predefined tolerance of a trajectory defined for the illegal turn. As indicated in field 360, the corresponding action consists of issuing a ticket for an illegal turn when the rule is triggered.

Figure 4:
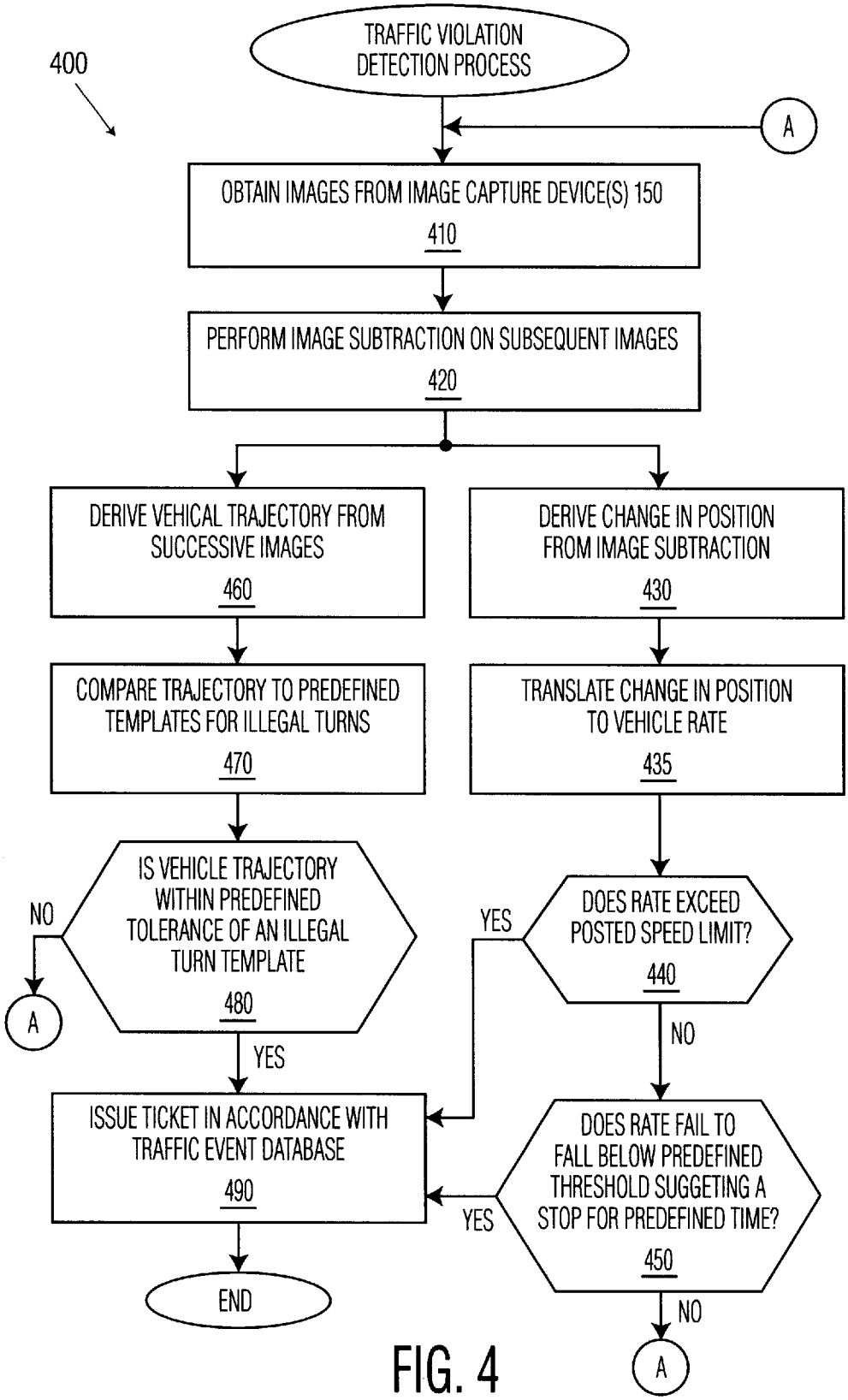
FIG. 4 is a flow chart describing an exemplary traffic violation detection process embodying principles of the present invention.

FIG. 4 is a flow chart describing an exemplary traffic violation detection process 400. The traffic violation detection process 400 processes images obtained from the image capture devices 150 and detects a number of specific, yet exemplary, traffic violations. As shown in FIG. 4, the traffic violation detection process 400 initially obtains one or more images of the roadway 200 from the image capture devices 150 during step 410. Thereafter, image subtraction is performed on subsequent image during step 420. The image subtraction information is then processed along parallel processing threads during steps 430 and 460. It is noted, however, that the image subtraction information can be processed in a serial manner as well, as would be apparent to a person of ordinary skill in the art.

The image subtraction information is processed during step 430 to derive the change in position of the vehicle 210. The change in position of the vehicle is translated during step 435 to determine the vehicle's rate of speed, in a known manner. A test is performed during step 440 to determine if the vehicle rate determined in the previous step exceeds the posted speed limit 220-N. If it is determined during step 440 that the vehicle rate exceeds the posted speed limit 220-N, then program control proceeds to step 490 to process the detected event, in a manner discussed below.

If, however, it is determined during step 440 that the rate determined in the previous step does not exceed the posted speed limit 220-N, then a further test is performed during step 450 to determine if the vehicle rate fails to fall below a predefined threshold for a predefined period of time, to suggest that the vehicle has stopped at the stop sign 220-1. If it is determined during step 450 that the vehicle rate fails to fall below a predefined threshold for a predefined period of time, then program control proceeds to step 490 to process the detected event, in a manner discussed below.

If, however, it is determined during step 450 that the vehicle rate does fall below a predefined threshold for a predefined period of time, then program control returns to step 410 and continues monitoring vehicular traffic in the manner discussed above.

The image subtraction information is also processed during step 460 to derive the vehicle trajectory 240. The vehicle trajectory 240 is then compared to predefined templates for illegal turns during step 470. A test is performed during step 480 to determine if the vehicle trajectory 240 is within a predefined tolerance of an illegal turn template in violation of traffic control sign 220-2. If it is determined during step 480 that the vehicle trajectory 240 is not within a predefined tolerance of an illegal turn template, then program control returns to step 410 and continues monitoring vehicular traffic in the manner discussed above.

If, however, it is determined during step 480 that the vehicle trajectory 240 is within a predefined tolerance of an illegal turn template, then program control proceeds to step 490 to process the detected event. As shown in FIG. 4, the event detected during steps 440, 450 or 480 is processed, and a ticket is issued during step 490 in accordance with the action item specified in the traffic event database 300. Thereafter program control terminates (or returns to step 410 and continues monitoring vehicular traffic in the manner discussed above).

Figure 5:
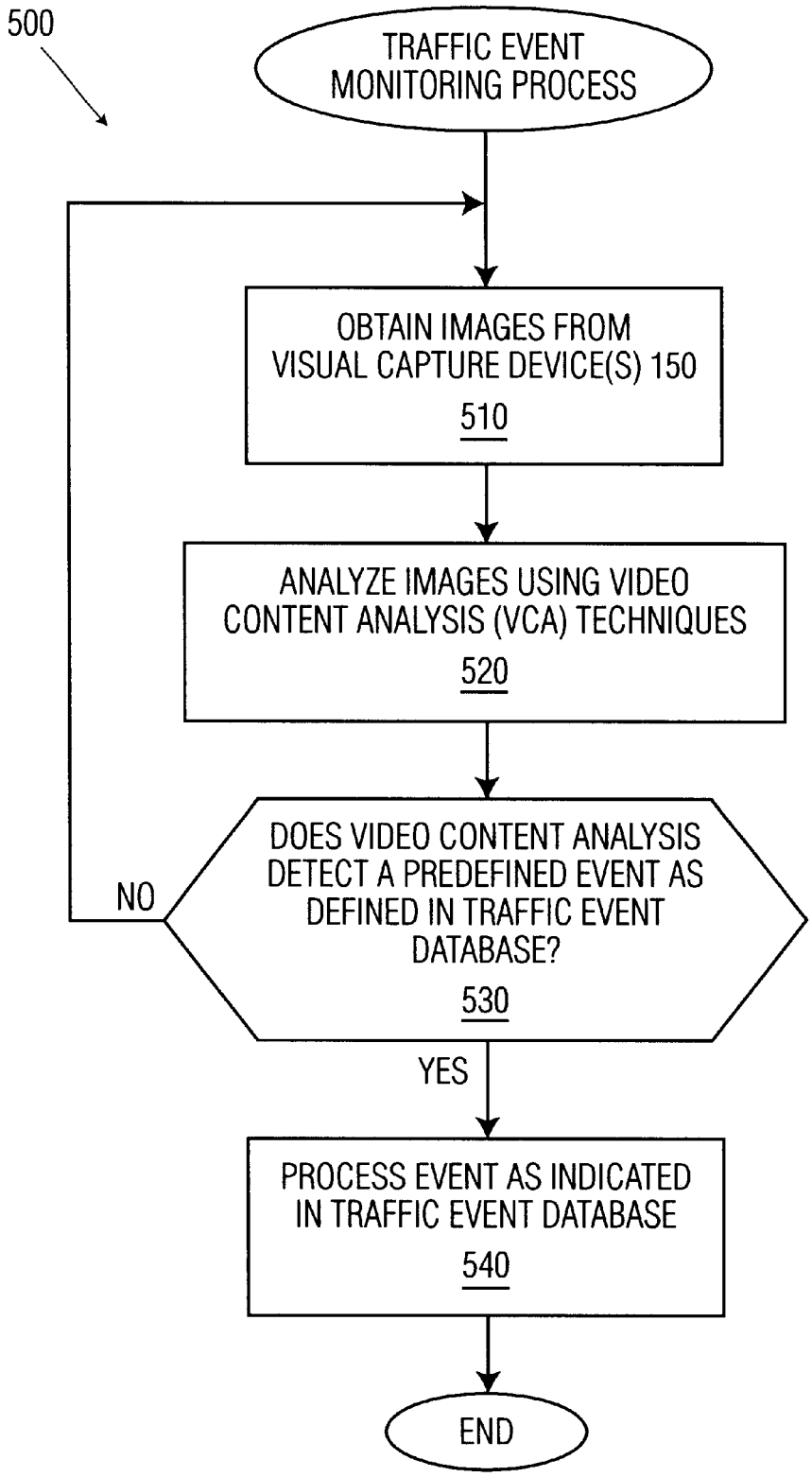
FIG. 5 is a flow chart describing an exemplary traffic event monitoring process embodying principles of the present invention.

FIG. 5 is a flow chart describing an exemplary traffic event monitoring process 500. The traffic event monitoring process 500 is a more general process illustrating the broader concepts of the present invention. The traffic event monitoring process 500 processes images obtained by the image capture devices 150 and detects one or more events defined in the traffic event database 300. As shown in FIG. 5, the traffic event monitoring process 500 initially obtains one or more images of the roadway 200 from the image capture devices 150 during step 510.

Thereafter, the images are analyzed during step 520 using video content analysis (VCA) techniques. For a detailed discussion of suitable VCA techniques, see, for example, Nathanael Rota and Monique Thonnat, "Video Sequence Interpretation for Visual Surveillance," in Proc. of the 3d IEEE Int'l Workshop on Visual Surveillance, 59–67, Dublin, Ireland (Jul. 1, 2000), and Jonathan Owens and Andrew Hunter, "Application of the Self-Organizing Map to Trajectory Classification,' in Proc. of the 3d IEEE Int'l Workshop on Visual Surveillance, 77–83, Dublin, Ireland (Jul. 1, 2000), incorporated by reference herein. Generally, the VCA techniques are employed to recognize various features in the images obtained by the image capture devices 150.

A test is performed during step 530 to determine if the video content analysis detects a predefined event, as defined in the traffic event database 300. If it is determined during step 530 that the video content analysis does not detect a predefined event, then program control returns to step 510 to continue monitoring vehicular traffic in the manner discussed above.

If, however, it is determined during step 530 that the video content analysis detects a predefined event, then the event is processed during step 540 as indicated in field 360 of the traffic event database 300. Program control then terminates (or returns to step 510 and continues monitoring vehicular traffic in the manner discussed above).

It is to be understood that the embodiments and variations shown and described herein are merely illustrative of the principles of this invention and that various modifications may be implemented by those skilled in the art without departing from the scope and spirit of the invention.

What is claimed is:

1. A method for detecting a vehicular traffic event, comprising:

establishing at least one rule defining said vehicular traffic event, said rule including at least one condition and an action item to be performed when said rule is satisfied;

processing at least one image of vehicular traffic to identify said condition; and performing said action item if said rule is satisfied, wherein said vehicular traffic event is a traffic violation selected from the group consisting of an illegal turn, an excessive speed and a failure to stop at a stop sign.

2. The method of claim 1, wherein said processing step further comprises the step of subtracting subsequent images to derive a vehicle speed.

3. The method of claim 2, wherein said processing step further comprises the step of determining if said vehicle speed exceeds a posted limit.

4. The method of claim 2, wherein said processing step further comprises the step of determining if said vehicle speed fails to indicate that said vehicle stopped at a stop sign.

5. The method of claim 1, wherein said processing step further comprises the step of employing image subtraction on subsequent images to derive a vehicle trajectory and wherein said vehicle trajectory is compared to one or more templates corresponding to an illegal turn.

6. A method for detecting a vehicular traffic event, comprising:

obtaining at least one image of vehicular traffic;

analyzing said image using video content analysis techniques to identify at least one predefined feature in said image associated with said vehicular traffic event; and identifying said vehicular traffic event if said predefined feature is recognized in one of said images, wherein said vehicular traffic event is a traffic violation selected from the group consisting of an illegal turn, an excessive speed and a failure to stop at a stop sign.

7. The method of claim 6, wherein said method further comprises the step of issuing a ticket for said traffic violation.

8. The method of claim 6, wherein said analyzing step further comprises the step of subtracting subsequent images to derive a vehicle speed.

9. The method of claim 8, wherein said analyzing step further comprises the step of determining if said vehicle speed exceeds a posted limit.

10. The method of claim 8, wherein said analyzing step further comprises the step of determining if said vehicle speed fails to indicate that said vehicle stopped at a stop sign.

11. The method of claim 6, wherein said analyzing step further comprises the step of employing image subtraction on subsequent images to derive a vehicle trajectory and wherein said vehicle trajectory is compared to one or more templates corresponding to an illegal turn.

12. A system for detecting a vehicular traffic event, comprising:

a memory for storing computer readable code and a user profile; and a processor operatively coupled to said memory, said processor configured to:

establish at least one rule defining said vehicular traffic event, said rule including at least one condition and an action item to be performed when said rule is satisfied; and process at least one image of vehicular traffic to identify said condition, wherein said vehicular traffic event is a traffic violation selected from the group consisting of an illegal turn, an excessive speed and a failure to stop at a stop sign.

13. An article of manufacture for detecting a vehicular traffic event, comprising:

a computer readable medium having computer readable code means embodied thereon, said computer readable program code means comprising:

a step to establish at least one rule defining said vehicular traffic event, said rule including at least one condition and an action item to be performed when said rule is satisfied;

a step to process at least one image of vehicular traffic to identify said condition, wherein said vehicular traffic event is a traffic violation selected from the group consisting of an illegal turn, an excessive speed and a failure to stop at a stop sign.

* * * * *